US007990372B2

(12) United States Patent
Kwon et al.

(10) Patent No.: US 7,990,372 B2
(45) Date of Patent: Aug. 2, 2011

(54) POWER SUPPLY APPARATUS AND LIQUID CRYSTAL DISPLAY INCLUDING THE SAME

(75) Inventors: Dal-jung Kwon, Seoul (KR); Moon-shik Kang, Seongnam-si (KR); Young-sub Kwon, Seoul (KR); Eui-dong Hwang, Incheon (KR)

(73) Assignee: Samsung Electronics Co., Ltd. (KR)

( * ) Notice: Subject to any disclaimer, the term of this patent is extended or adjusted under 35 U.S.C. 154(b) by 970 days.

(21) Appl. No.: 11/861,696

(22) Filed: Sep. 26, 2007

(65) Prior Publication Data

US 2008/0074578 A1 Mar. 27, 2008

(30) Foreign Application Priority Data

Sep. 27, 2006 (KR) ..... 10-2006-0094263

(51) Int. Cl.
*G09G 5/00* (2006.01)

(52) U.S. Cl. ..... 345/211; 345/87

(58) Field of Classification Search ..... 345/52, 345/53, 87, 211–214; 315/224
See application file for complete search history.

(56) References Cited

U.S. PATENT DOCUMENTS 6,617,807 B2 * 9/2003 Ito et al. ..... 315/276
6,617,809 B2 * 9/2003 Ito et al. ..... 315/312
7,560,872 B2 * 7/2009 Lyle et al. ..... 315/220
2002/0109468 A1 * 8/2002 Takeda et al. ..... 315/291
2005/0104540 A1 * 5/2005 Wood ..... 315/291
2008/0018265 A1 * 1/2008 Lee et al. ..... 315/291

FOREIGN PATENT DOCUMENTS

CN 1271207 A 10/2000
CN 1366292 A 8/2002
CN 1617438 A 5/2005
KR 20030003684 1/2003
WO 2005109967 11/2005

OTHER PUBLICATIONS

CN Office Action dated Sep. 20, 2010 issued during the examination of the corresponding Chinese patent application. (No. 200710164881.0).
Chinese Office Action for Application No. 200710164881.0 dated Apr. 28, 2011 with English Translation.

* cited by examiner

*Primary Examiner* — Nitin Patel
(74) *Attorney, Agent, or Firm* — Cantor Colburn LLP

(57) ABSTRACT

A power supply apparatus capable of reducing power consumption and a liquid crystal display including the power supply apparatus includes a first DC-AC converting unit enabled by a driving signal to convert a DC voltage into a first AC voltage, increase the first AC voltage, and supply the increased first AC voltage as a first power supply voltage; a switching unit which selectively transmits the driving signal in response to a selection signal; and a second DC-AC converting unit enabled by the driving signal selectively transmitted by the switching unit to convert the DC voltage into a second AC voltage, increase the second AC voltage, and supply the increased second AC voltage as a second power supply voltage.

18 Claims, 14 Drawing Sheets

| SEL | CONT_P | G1 | PRIMARY COIL | SECOND LAMP |
|---|---|---|---|---|
| L | L | L | AC IS APPLIED | ON |
| | H | H | | |
| H | L | H | AC IS NOT APPLIED | OFF |
| | H | H | | |

| SEL | CONT_N | G2 | PRIMARY COIL | SECOND LAMP |
|---|---|---|---|---|
| L | L | L | AC IS APPLIED | ON |
| | H | H | | |
| H | L | L | AC IS NOT APPLIED | OFF |
| | H | L | | |

| SEL | CONT_P(CONT_N) | G3 | G4 | PRIMARY COIL | SECOND LAMP |
|---|---|---|---|---|---|
| L | L | L | L | AC IS APPLIED | ON |
| | H | H | H | | |
| H | L | H | L | AC IS NOT APPLIED | OFF |
| | H | H | L | | |

| SEL | CONT_N | G5 | PRIMARY COIL | SECOND LAMP |
|---|---|---|---|---|
| L | L | L | AC IS APPLIED | ON |
| | H | H | | |
| H | L | L | AC IS NOT APPLIED | OFF |
| | H | L | | |

POWER SUPPLY APPARATUS AND LIQUID CRYSTAL DISPLAY INCLUDING THE SAME

This application claims priority to Korean Patent Application No. 10-2006-0094263, filed on Sep. 27, 2006, and all the benefits accruing therefrom under 35 U.S.C. §119, the contents of which in its entirety are herein incorporated by reference.

BACKGROUND OF THE INVENTION

1. Field of the Invention

The present invention relates generally to a power supply apparatus and a liquid crystal display including the same, and more particularly, to a power supply apparatus capable of reducing power consumption and a liquid crystal display including the same.

2. Description of the Related Art

A liquid crystal display "LCD" typically includes a liquid crystal panel, which has a first display panel including a plurality of pixel electrodes, a second display panel including a common electrode, and a liquid crystal layer with dielectric anisotropy interposed between the first and second display panels. An electric field is formed between the pixel electrode and the common electrode. When the strength of the electric field is adjusted, the amount of light passing through the liquid crystal panel is controlled, which results in a desired image to be displayed.

Such a liquid crystal display is not a self-emitting display, and is thus provided with a plurality of lamps serving as a light source. If all of the lamps are driven, the power consumption is at a maximum. However, depending upon a user's intention or a usage state of a device including an LCD, it is desirable to reduce the power consumption of the display. For example, where the LCD power source is a battery, in order to reduce the power consumption of the lamps (and hence conserve battery power), to the lamps are selectively driven.

BRIEF SUMMARY OF THE INVENTION

Aspects of the present invention provide a power supply apparatus capable of reducing power consumption.

Aspects of the present invention also provide a liquid crystal display capable of reducing power consumption.

According to an exemplary embodiment of the present invention, there is provided a power supply apparatus including: a first DC-AC converting unit enabled by a driving signal to convert a DC voltage into a first AC voltage, increase the first AC voltage and to supply the increased first AC voltage as a first power supply voltage; a switching unit which selectively transmits the driving signal in response to a selection signal; and a second DC-AC converting unit enabled by the driving signal selectively transmitted by the switching unit to convert the DC voltage into a second AC voltage, increase the second AC voltage, and supply the increased second AC voltage as a second power supply voltage.

According to another exemplary embodiment of the present invention, there is provided a power supply apparatus including: a first DC-AC converting unit enabled by a driving signal to convert a DC voltage into a first AC voltage, increase the first AC voltage and to supply the increased first AC voltage as a first power supply voltage; a switching unit which selectively transmits the DC voltage in response to a selection signal; and a second DC-AC converting unit enabled by the driving signal to convert the DC voltage selectively transmitted by the switching unit into a second AC voltage, increase the second AC voltage, and supply the increased second AC voltage as a second power supply voltage.

According to another exemplary embodiment of the present invention, they are is provided a liquid crystal display including: a backlight assembly that emits light and having a plurality of lamps arranged into a first lamp unit and a second lamp unit and a power supply apparatus that supplies a power supply voltage to the first lamp unit and selectively supplies the power supply voltage to the second lamp unit in response to a selection signal; and a liquid crystal panel assembly that receives the light emitted from the backlight assembly and implements an image display.

Details of other exemplary embodiments are included in this specification and the accompanying drawings.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION OF THE INVENTION

Figure 1:
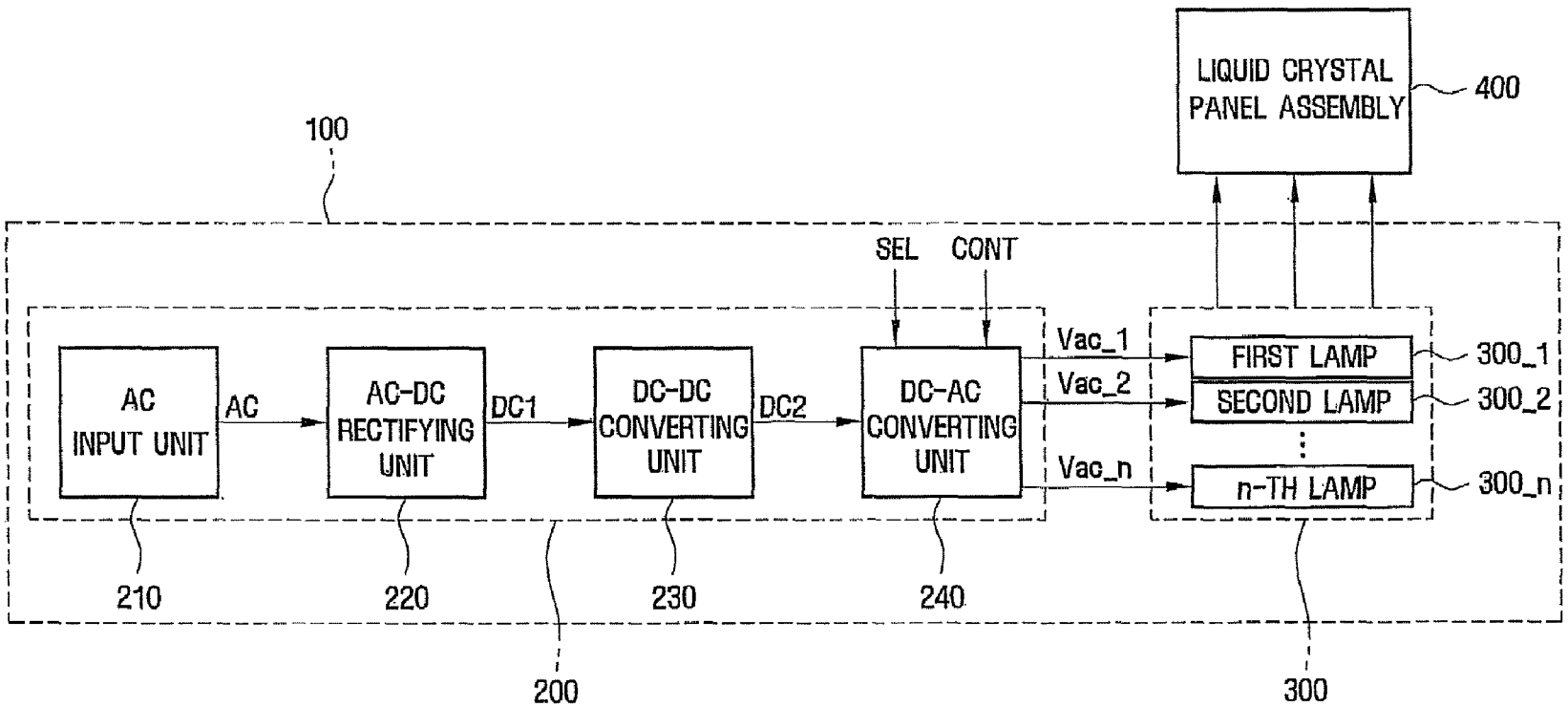
FIG. 1 is a block diagram illustrating a liquid crystal display according to an exemplary embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

A liquid crystal display according to an exemplary embodiment of the invention will now be described with reference to FIG. 1. FIG. 1 is a block diagram illustrating a liquid crystal display according to an exemplary embodiment of the invention.

Referring to FIG. 1, a liquid crystal display 1 according to an exemplary embodiment of the invention includes a backlight assembly 100 and a liquid crystal panel assembly 400, with the backlight assembly 100 further including a power supply apparatus 200 and a plurality of lamps 300.

The power supply apparatus 200 includes an AC input unit 210, an AC-DC rectifying unit 220, a DC-DC converting unit 230, and a DC-AC converting unit 240. The lamps 300 are classified into a first lamp unit (300_1 and **300_*n*) and a second lamp unit (300_2). The power supply apparatus 200 supplies power supply voltages Vac_1** and Vac_*n* to the first lamp unit 300_1 and **300_*n* and selectively supplies a power supply voltage Vac_2 to the second lamp unit 300-2 in response to a selection signal "SEL". As described herein, the "first lamp unit" and the "second lamp unit" are used to distinguish between a lamp to which the power supply apparatus 200 continuously supplies a power supply voltage from a lamp to which the power supply apparatus 200** selectively supplies a power supply voltage. A "lamp unit" may refer to one or more lamps, and thus does not necessarily mean a plurality of lamps.

In an exemplary embodiment, an input AC voltage of 120 V is supplied to the AC input unit 210, such as through a plug that is plugged into a receptacle outlet.

The AC-DC rectifying unit 220 converts the output AC voltage "AC" of the AC input unit 210 into a first DC voltage DC1 and supplies the first DC voltage DC1 to the DC-DC converting unit 230. The AC-DC rectifying unit 220 may have a PFC (power factor correction) function associated therewith.

The DC-DC converting unit 230 converts the first DC voltage DC1 into a second DC voltage DC2. In one embodiment, the second DC voltage DC2 may have a voltage level higher than the first DC voltage DC1. The DC-DC converting unit 230 may be a buck converter or a boost converter.

In the event that the liquid crystal display 1 uses a battery as the input power source thereto, the AC input unit 210 and the AC-DC rectifying unit 220 may be omitted . The DC-DC converting unit 230 may also be omitted if not necessary.

The DC-AC converting unit 240 is enabled by a driving signal CONT to convert the second DC voltage DC2 into power supply voltages Vac_1 to Vac_n. The DC-AC converting unit 240 may selectively supply the power supply voltage Vac_2 to the second lamp unit 300_2 in response to the selection signal SEL. The DC-AC converting unit 240 may include a plurality of inverter circuits, wherein the inverter circuit may be a half bridge inverter, a full bridge inverter, or a push-pull inverter. The driving signal CONT may be a signal for controlling brightness and supplied from a controller (not shown) formed in an integrated circuit. The selection signal SEL may also be supplied from the same or a different controller (not shown) formed in an integrated circuit.

The power supply voltages Vac_1 to Vac_n may be selectively supplied to all or some of the lamps 300_1 to 300_*n* by supplying the second DC voltage DC2 to all or some of the plurality of inverter circuits in response to the selection signal SEL or by supplying the driving signal CONT to all or some of the plurality of inverter circuits in response to the selection signal SEL. The internal circuits and detailed operation of the DC-AC converting unit 240 will be described below with reference to FIGS. 3A to 10.

A lamp unit 300 includes the plurality of lamps 300_1 to 300_*n* and emits light using the power supply voltages Vac_1 to Vac_n supplied from the power supply apparatus 200. Since the power supply apparatus 200 selectively supplies the power supply voltages Vac_1 to Vac_n, all or some of the plurality of lamps 300_1 to 300_*n* emit light.

The backlight assembly 100 may be an edge type or a direct type assembly. In the case of an edge type assembly, the backlight assembly 100 may also include a light guiding plate and one or two lamps are provided at one or both sides of the light guiding plate.

The liquid crystal panel assembly 400 receives light from the backlight assembly 100 and displays images.

The liquid crystal display 1 can selectively drive all or some of the plurality of lamps 300_1 to 300_*n* according to user's intention or circumstances. For example, when it is not necessary to increase luminance in respect to the environment, only some of the lamps 300_1 to 300_*n* may be driven, thereby reducing the power consumption.

Figure 2:
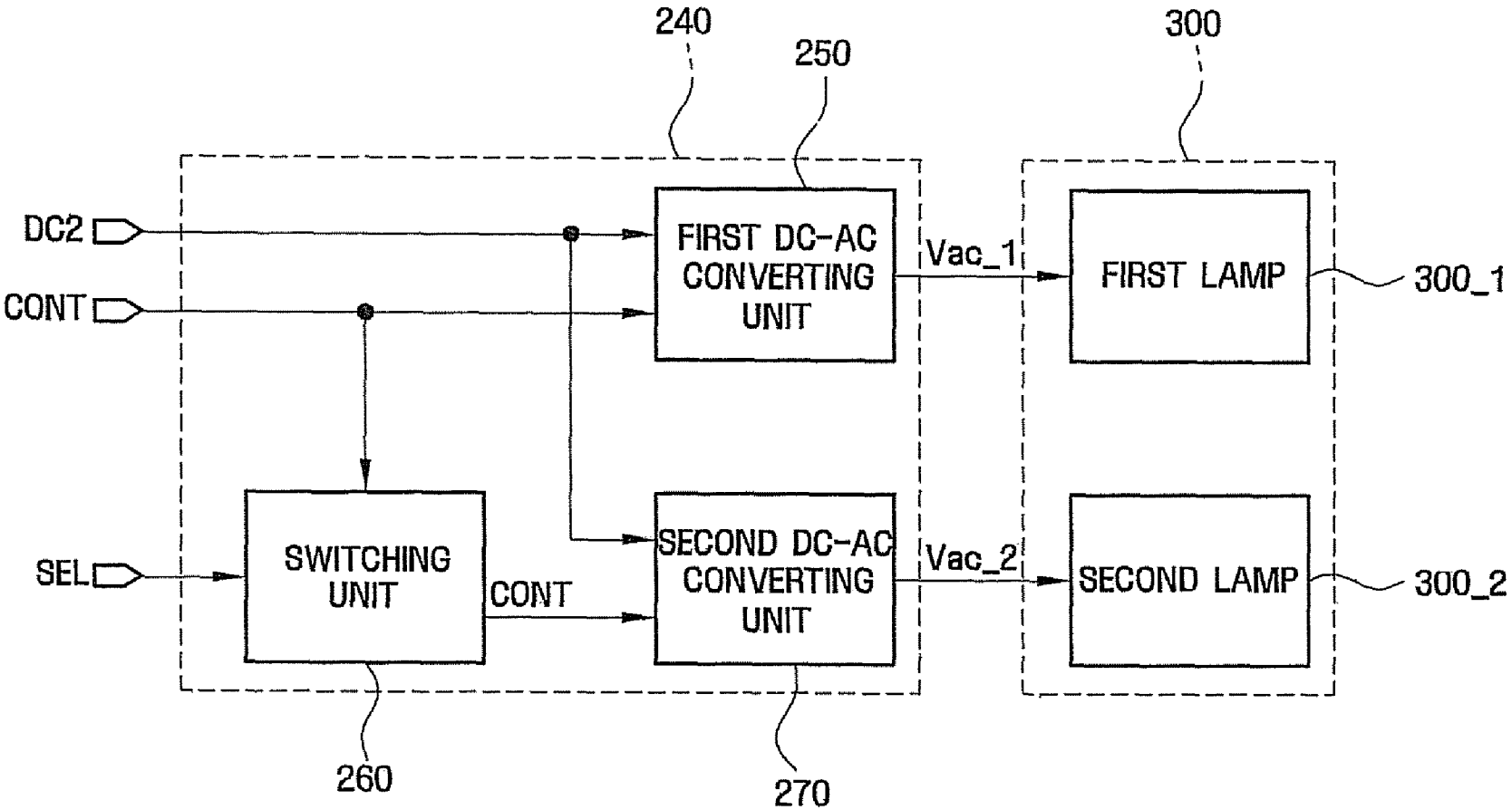
FIG. 2 is a block diagram illustrating a power supply apparatus according to another exemplary embodiment of the present invention.

FIG. 2 is a block diagram illustrating a power supply apparatus according to an exemplary embodiment of the invention. For purposes of simplicity, an example in which the first lamp unit and the second lamp unit each have one lamp is described.

Referring to FIG. 2, the DC-AC converting unit 240 of the power supply apparatus 200 of FIG. 1 includes a first DC-AC converting unit 250, a second DC-AC converting unit 270, and a switching unit 260.

The first DC-AC converting unit 250 is enabled by the driving signal CONT to convert the second DC voltage DC2 into the power supply voltage Vac_1 and supply the power supply voltage Vac_1 to the first lamp unit 300_1.

In response to the selection signal SEL, the switching unit 260 either transmits the driving signal CONT to the second DC-AC converting unit 270 or blocks the driving signal CONT. In other words, selection signal SEL selectively enables or disables the driving signal CONT from controlling the second DC-AC converting unit 270.

When the switching unit 260 passes the driving signal CONT, the second DC-AC converting unit 270 converts the second DC voltage DC2 into the power supply voltage Vac_2 and supplies the power supply voltage Vac_2 to the second lamp unit 300_2. Conversely, when the switching unit 260 blocks the driving signal CONT, the second DC-AC converting unit 270 does not convert the second DC voltage DC2 into the power supply voltage Vac_2.

Therefore, the power supply apparatus 200 (FIG. 1) can selectively drive the lamps 300_1 and 300_2.

Exemplary embodiments will now be described with reference to FIGS. 3A to 6C.

Figure 3A:
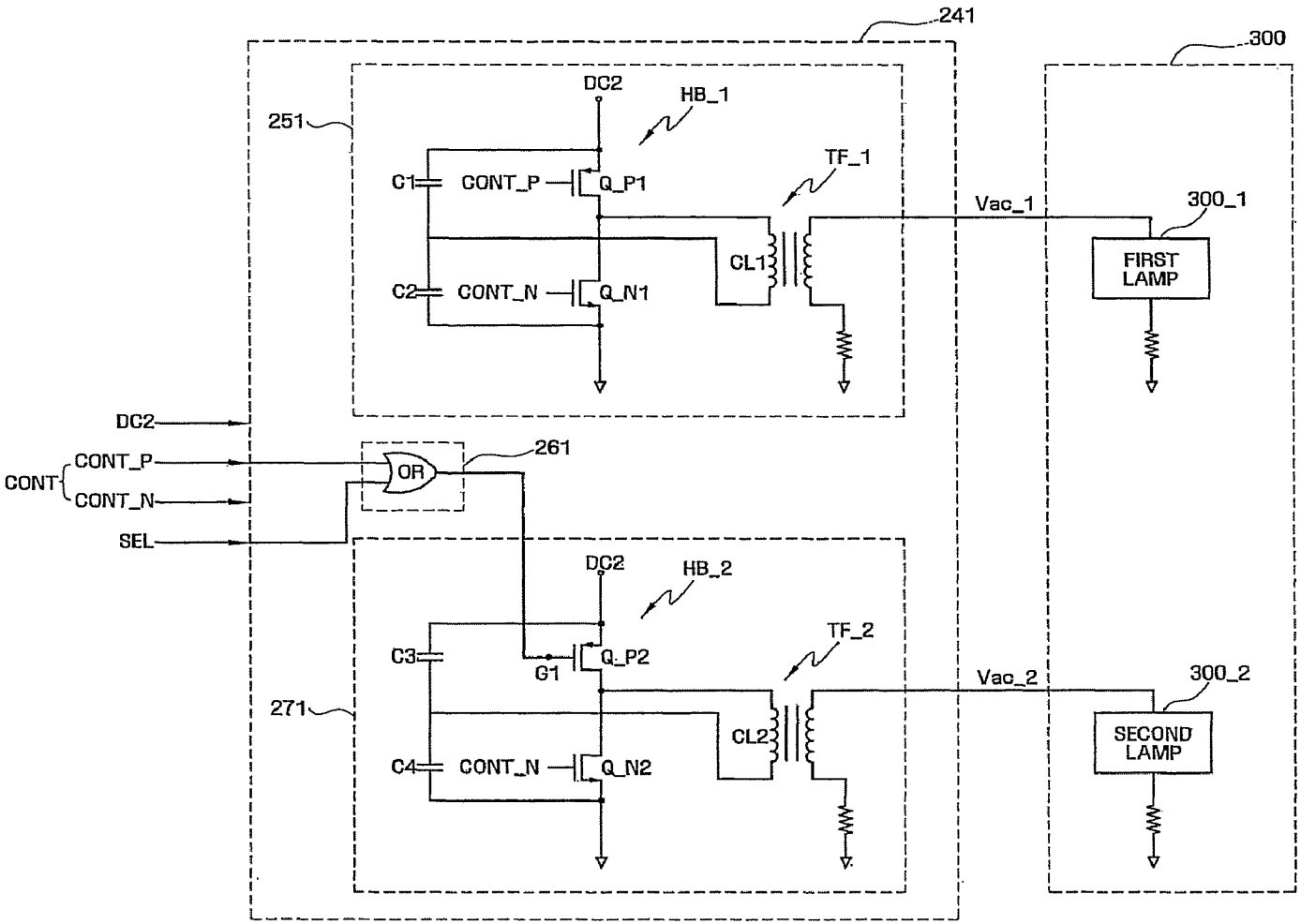
FIG. 3A is a circuit diagram illustrating an exemplary embodiment of the DC-AC converting unit of the power supply apparatus shown in FIGS. 1 and 2.
Figures 3B, 3C:
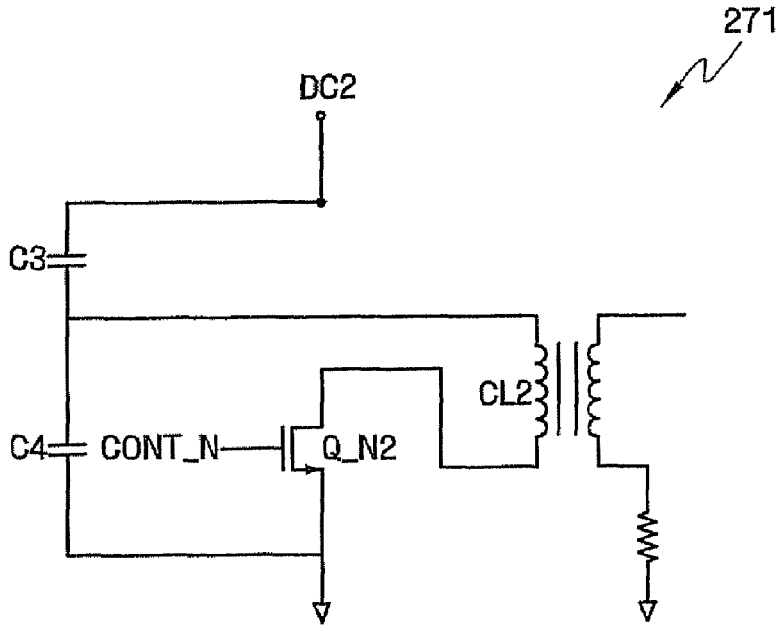
FIG. 3B is an equivalent circuit diagram of the second DC-AC converting unit included in the DC-AC converting unit of FIG. 3A when a selection signal is at a high level.
FIG. 3C is a table illustrating the operation of the second DC-AC converting unit of FIG. 3A.

FIG. 3A is a circuit diagram illustrating an exemplary embodiment of the DC-AC converting unit of the power supply apparatus shown in FIGS. 1 and 2, FIG. 3B is an equivalent circuit diagram of the second DC-AC converting unit included in the DC-AC converting unit of FIG. 3A when the selection signal SEL is at a high level, and FIG. 3C is a table illustrating the operation of the second DC-AC converting unit of FIG. 3A.

First, referring to FIG. 3A, a first DC-AC converting unit 251 includes a half-bridge inverter HB_1 and a transformer TF_1, and a second DC-AC converting unit 271 includes a half-bridge inverter HB_2 and a transformer TF_2.

The half-bridge inverter HB_1 includes two MOS transistors Q_P1 and Q_N1 and two capacitors C1 and C2, and the half-bridge inverter HB_2 includes two MOS transistors Q_P2 and Q_N2 and two capacitors C3 and C4. In the embodiment depicted in FIG. 3A, the two MOS transistors Q_P1 and Q_P2 are PMOS transistors and the two MOS transistors Q_N1 and Q_N2 are NMOS transistors. However, the invention is not limited thereto. For example, both of the two MOS transistors Q_P1 and Q_N1 may be PMOS transistors or NMOS transistors, and both of the two MOS transistors Q_P2 and Q_N2 may be PMOS transistors or NMOS transistors.

The half-bridge inverter HB_1 of the first DC-AC converting unit 251 is enabled by the driving signal CONT, which includes a P-type driving signal CONT_P and an N-type driving signal CONT_N to convert the second DC voltage DC2 into an AC voltage at a predetermined level. The transformer TF_1 of the first DC-AC converting unit 251 is supplied with an AC voltage at a predetermined level from the half-bridge inverter HB_1, increases (steps up) the AC voltage, and outputs the increased AC voltage as the power supply voltage Vac_1.

The first capacitor C1 and the second capacitor C2 are charged with voltages at predetermined levels over which the second DC voltage DC2 is divided. For example, the first capacitor C1 and the second capacitor C2 each may be charged to half of the second DC voltage DC2. The third and fourth capacitors C3 and C4 are charged in a similar manner with respect to the second DC-AC converting unit 271.

The P-type driving signal CONT_P and the N-type driving signal CONT_N are input to a gate of a first PMOS transistor Q_P1 and a gate of a first NMOS transistor Q_N1, respectively, such that the first PMOS transistor Q_P1 and the first NMOS transistor Q_N1 are alternately enabled. That is, when the first PMOS transistor Q_P1 is turned on, the first NMOS transistor Q_N1 is turned off, and when the first PMOS transistor Q_P1 is turned off, the first NMOS transistor Q_N1 is turned on.

Therefore, a voltage at a predetermined level is applied to a primary coil CL1 of the transformer TF_1 while the polarity of the voltage varies. For example, if the second DC voltage DC2 is 12V, then voltages of +6 V and −6 V are alternately applied to the primary coil CL1 of the transformer TF_1.

The transformer TF_1 increases the AC voltage applied to the primary coil CL1 and outputs the increased AC voltage as the power supply voltage Vac_1. When the power supply voltage Vac_1 is supplied, the first lamp unit 300_1 emits light.

In contrast to the first DC-AC converting unit 251, the P-type driving signal is not directly applied to PMOS transistor Q_P2. Rather, the switching unit 261 selectively passes or block the P-type driving signal CONT_P to a gate G1 of the second PMOS transistor Q_P2 based on the value of the selection signal SEL. Accordingly, the second DC-AC converting unit 271 selectively supplies the power supply voltage Vac_2 to the second lamp unit 300_2. In the embodiment illustrated, the switching unit 261 includes an OR gate "OR" having the selection signal SEL and the P-type driving signal CONT_P as inputs thereto. The output of the OR gate is coupled to the gate G1 of PMOS transistor Q_P2.

An example in which the second DC-AC converting unit 271 supplies the power supply voltage Vac_2 to the second lamp unit 300_2 will now be described in detail with reference to FIGS. 3A and 3C.

When the selection signal SEL is at a logic low level L, the P-type driving signal CONT_P is effectively passed through to the gate G1 of the second PMOS transistor Q_P2. That is, when the P-type driving signal CONT_P is at a low level L, a logic low voltage level L is also applied to the gate G1 of the second PMOS transistor Q_P2, and when the P-type driving signal CONT_P is at a high level H, a logic high voltage level H is applied to the gate G1 of the second PMOS transistor Q_P2. Therefore, when SEL is at logic low, the second DC-AC converting unit 271 operates in the same manner as the first DC-AC converting unit 251, an AC voltage is applied to a primary coil CL2 of the transformer TF_2, and the transformer TF_2 increases (boosts) the applied AC voltage and supplies the increased AC voltage to the second lamp unit 300_2, such that the second lamp unit 300_2 emits light.

Next, an example in which the second DC-AC converting unit 271 does not supply the power supply voltage Vac_2 to the second lamp unit 300_2 will now be described in detail with reference to FIGS. 3B and 3C.

When the selection signal SEL is at a high level H, logic high voltage H is applied to the gate G1 of the second PMOS transistor Q_P2, regardless of the value of the P-type driving signal CONT_P. Therefore, the second PMOS transistor Q_P2 is turned off and thus the second DC-AC converting unit 271 becomes a circuit as illustrated in FIG. 3B. In this case, even though a second NMOS transistor Q_N2 is turned on or off according to the N-type driving signal CONT_N, an AC voltage is not applied to the primary coil CL2 and thus the transformer TF_2 does not output the power supply voltage Vac_2. As a result, the second lamp unit 300_2 is in an OFF state. Also, prior to the selection signal SEL transitioning to the low level L, the high level voltage H is continuously applied to the gate G1 of the second PMOS transistor Q_P2. Therefore, the second lamp unit 300_2 is held in the OFF state. That is, the gate G1 of the second PMOS transistor Q_P2 does not float but instead holds the voltage at the low level L.

Therefore, the DC-AC converting unit 241 selectively supplies the power supply voltage Vac_2 according to the value of selection signal SEL. Again, when the selection signal SEL is at the low level L, both of the first and second lamp units 300_1 and 300_2 emit light, whereas when the selection signal SEL is at the high level H, only the first lamp unit 300_1 emits light. In will be appreciated that the switching unit 260 could also be configured in a manner so as to supply the power supply voltages Vac_1 and Vac_2 to the first and second lamp units 300_1 and 300_2 when the selection signal SEL is at the low level, and supply only the power supply voltages Vac_1 to the first lamp unit 300_1 when the selection signal SEL is at the high level.

A power supply apparatus according to another exemplary embodiment of the invention will now be described with reference to FIGS. 4A to 4C.

Figure 4A:
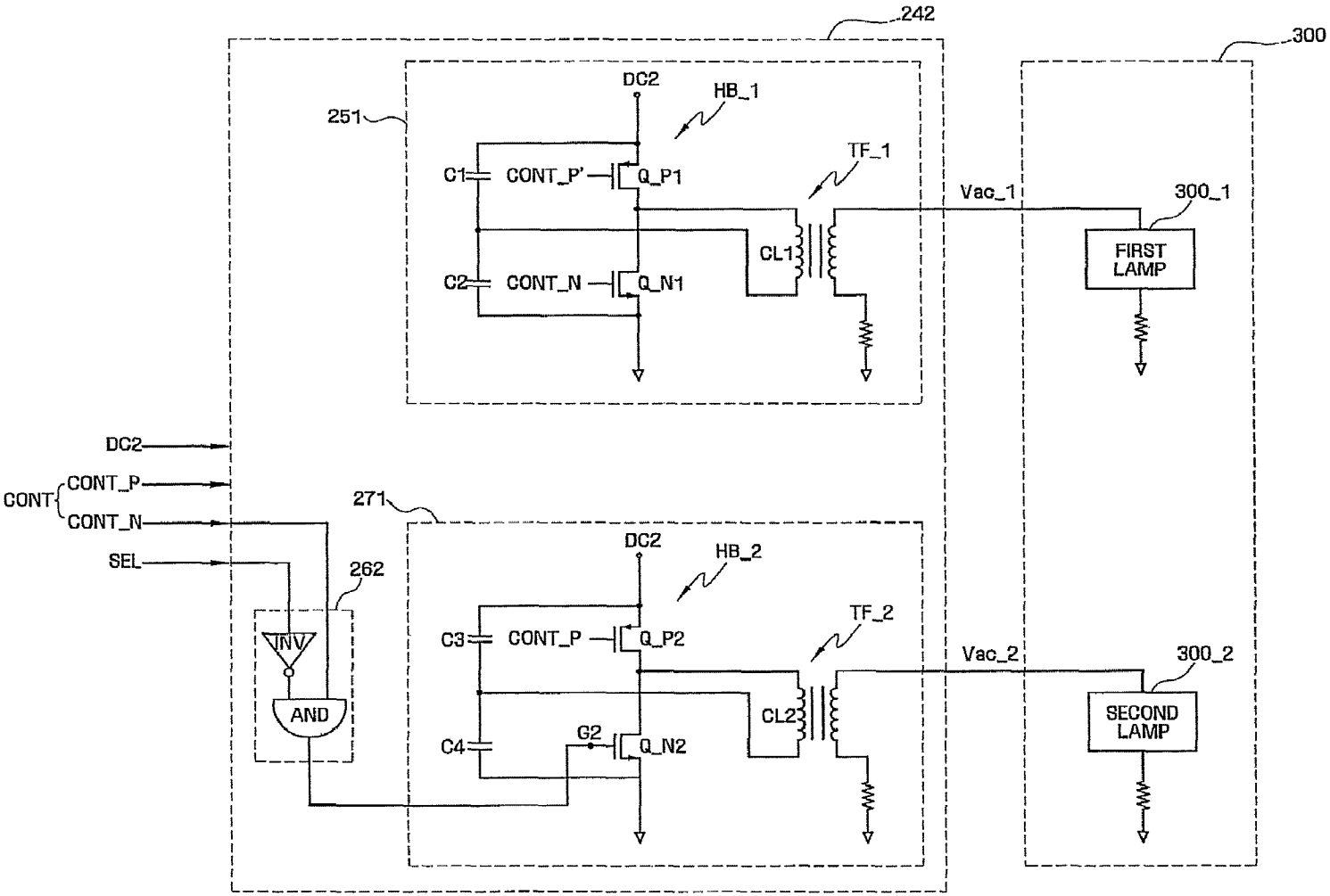
FIG. 4A is a circuit diagram illustrating another exemplary embodiment of the DC-AC converting unit of the power supply apparatus shown in FIGS. 1 and 2.
Figures 4B, 4C:
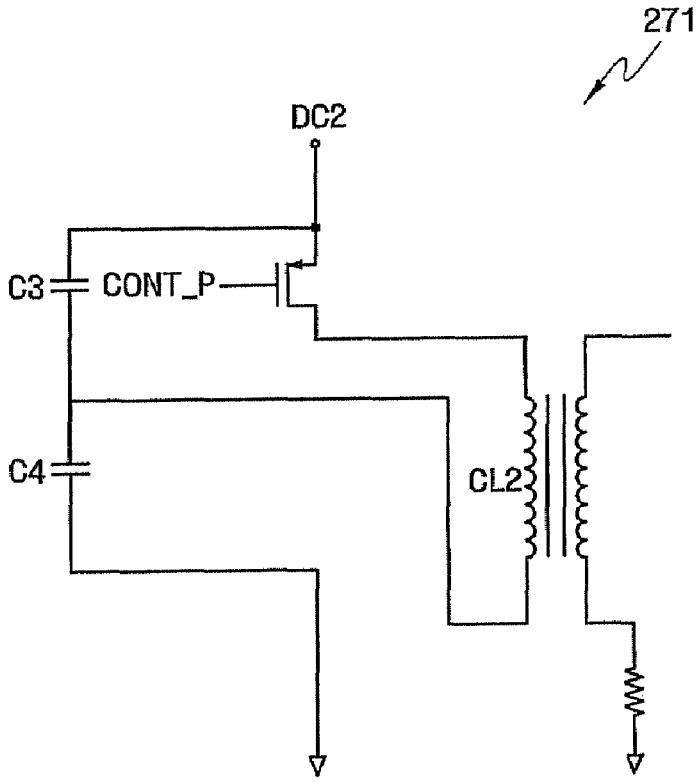
FIG. 4B is an equivalent circuit diagram of the second DC-AC converting unit included in the DC-AC converting unit of FIG. 4A when the selection signal is at the high level.
FIG. 4C is a table illustrating the operation of the second DC-AC converting unit of FIG. 4A.

FIG. 4A is a circuit diagram illustrating the DC-AC converting unit of the power supply apparatus according to another exemplary embodiment of the invention, FIG. 4B is an equivalent circuit diagram of the second DC-AC converting unit included in the DC-AC converting unit of FIG. 4A when the selection signal SEL is at the high level, and FIG. 4C is a table illustrating the operation of the second DC-AC converting unit of FIG. 4A. In FIGS. 4A and 4B, components having the same functions as the components illustrated in FIGS. 3A and 3B are denoted by the same reference numerals and a detailed description thereof is omitted for purposes of simplicity.

Referring to FIG. 4A, a switching unit 262 either supplies the N-type driving signal CONT_N to the gate G2 of the second NMOS transistor Q_N2 or blocks the N-type driving signal CONT_N, depending on the value of selection signal SEL, and thus a second DC-AC converting unit 271 selectively supplies or does not supply the power supply voltage Vac_2 to the second lamp unit 300_2. In the embodiment illustrated, the switching unit 262 includes an AND gate "AND" and an inverter INV, having the selection signal SEL and the N-type driving signal CONT_N as respective inputs thereto. The inverted value of SEL and the N-type driving signal CONT_N are inputs to the AND gate, and the output of the AND gate is coupled to the gate G2 of NMOS transistor Q_N2.

An example in which the second DC-AC converting unit 271 supplies the power supply voltage Vac_2 to the second unit lamp 300_2 will now be described in detail with reference to FIGS. 4A and 4C.

When the selection signal SEL is at the low level L, the N-type driving signal CONT_N is effectively passed through to the gate of the second NMOS transistor Q_N2. That is, when the selection signal SEL is at the low level L, the low level voltage L is applied to the gate G2 of the second NMOS transistor Q_N2, and when the N-type driving signal CONT_N is at the high level H, the high level voltage H is applied to the gate G2 of the second NMOS transistor Q_N2. Therefore, when SEL is at logic low, the second DC-AC converting unit 271 operates in the same manner as the above-mentioned first DC-AC converting unit 251, the AC voltage is applied to the primary coil CL2 of the transformer TF_2, and the transformer TF_2 increases the applied AC voltage and supplies the increased AC voltage to the second lamp unit 300_2. As a result, the second lamp unit 300_2 emits light.

An example in which the second DC-AC converting unit 271 does not supply the power supply voltage Vac_2 to the second lamp unit 300_2 will now be described in detail with reference to FIGS. 4B and 4C.

When the selection signal SEL is at the high level H, a low level voltage L is applied to the gate G2 of the second NMOS transistor Q_N2, regardless of the value of the value of the N-type driving signal CONT_N. Therefore, the second NMOS transistor Q_N2 is turned off and thus the second DC-AC converting unit 271 becomes a circuit as illustrated in FIG. 4B. In this case, even though the second PMOS transistor Q_P2 is turned on or off according to the P-type driving signal CONT_P, the AC voltage is not applied to the primary coil CL2 and thus the transformer TF_2 does not supply the power supply voltage Vac_2. As a result, the second lamp unit 300_2 is in an OFF state. Also, prior to the selection signal SEL transitioning to the low level L, the voltage at the, low level L is continuously applied to the gate G2 of the second NMOS transistor Q_N2. Therefore, the second lamp unit 300_2 is held in the OFF state.

Therefore, the DC-AC converting unit 242 selectively supplies the power supply voltage Vac_2 according to the value of the selection signal SEL such that both of the first and second lamp units 300_1 and 300_2 emit light or only the first lamp unit 300_1 emits light.

Figure 5A:
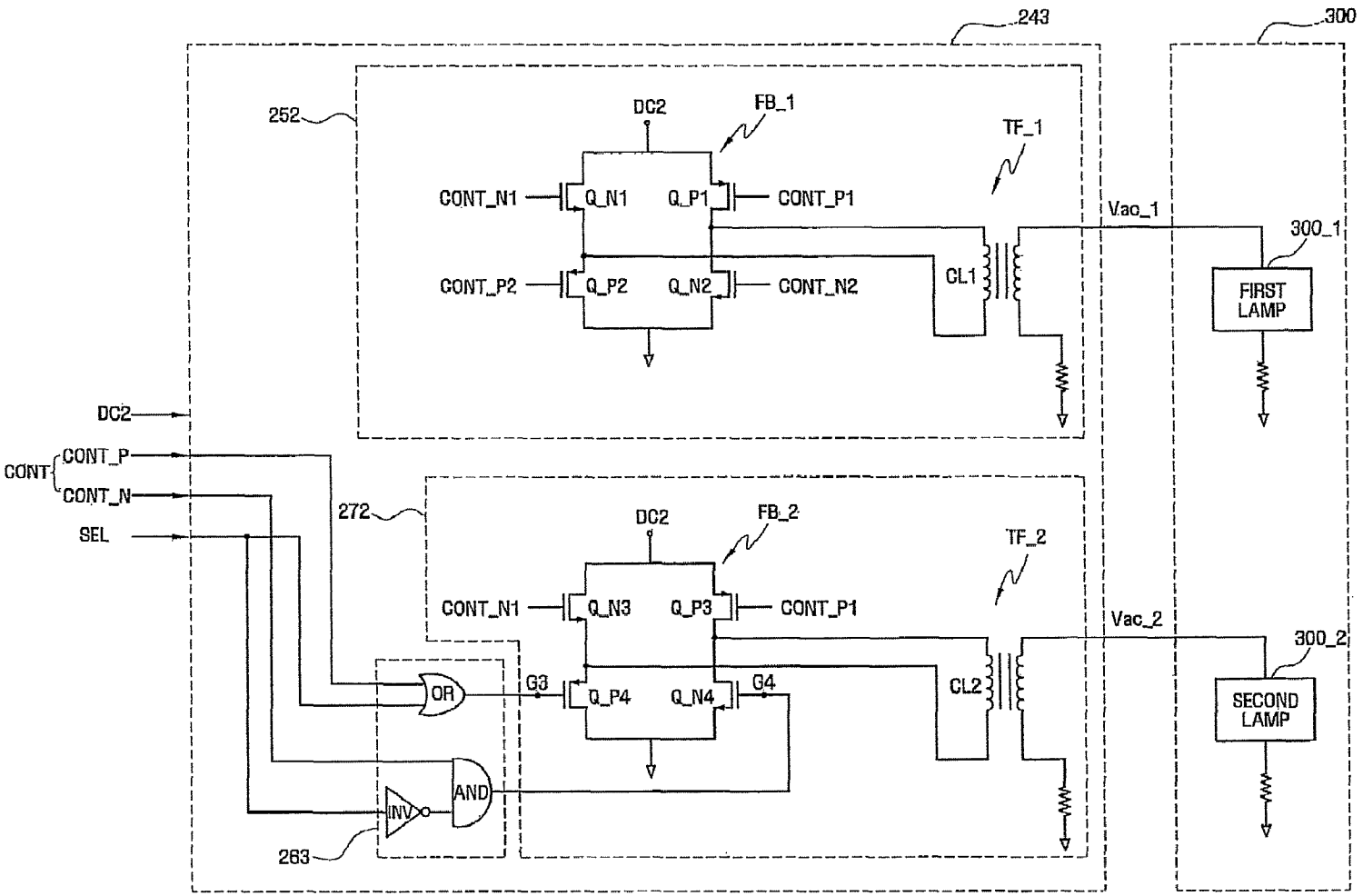
FIG. 5A is a circuit diagram illustrating another exemplary embodiment of the DC-AC converting unit of the power supply apparatus shown in FIGS. 1 and 2.
Figures 5B, 5C:
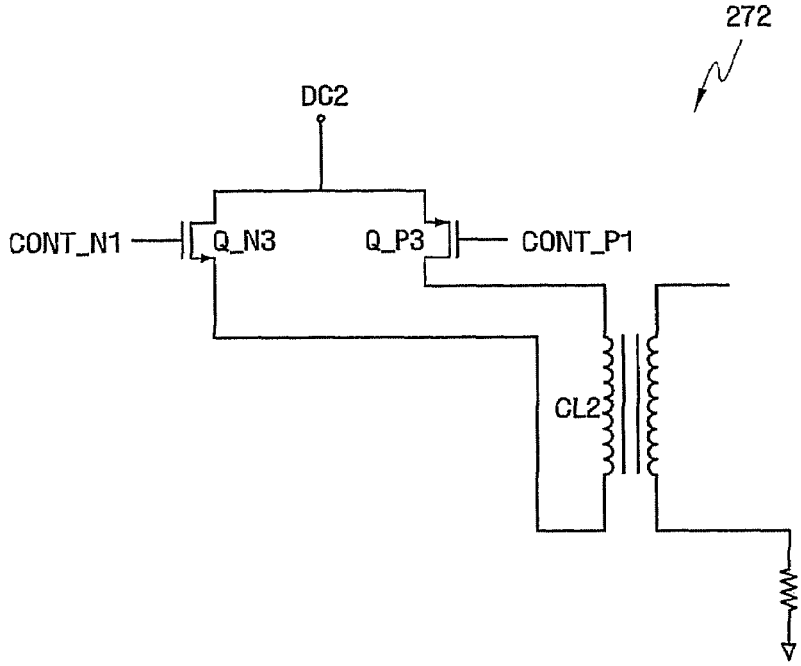
FIG. 5B is an equivalent circuit diagram of the second DC-AC converting unit included in the DC-AC converting unit of FIG. 5A when the selection signal is at the high level.
FIG. 5C is a table illustrating the operation of the second DC-AC converting unit of FIG. 5A.

A power supply apparatus according to another exemplary embodiment of the invention will now be described with reference to FIGS. 5A and 5C. FIG. 5A is a circuit diagram illustrating the DC-AC converting unit of the power supply apparatus according to another exemplary embodiment of the invention, FIG. 5B is an equivalent circuit diagram of a second DC-AC converting unit included in the DC-AC converting unit of FIG. 5A when the selection signal is at the high level, and FIG. 5C is a table illustrating the operation of the second DC-AC converting unit of FIG. 5A.

Referring to FIG. 5A, a first DC-AC converting unit 252 includes a full-bridge inverter FB_1 and a transformer TF_1, and a second DC-AC converting unit 272 includes a full-bridge inverter FB_2 and a transformer TF_2.

First, the full-bridge inverter FB_1 includes four MOS transistors Q_P1, Q_N1, Q_P2, and Q_N2, and the full-bridge inverter FB_2 includes four MOS transistors Q_P3, Q_N3, Q_P4, and Q_N4. FIG. 5A illustrates an embodiment where the MOS transistors Q_P1, Q_P2, Q_P3, and Q_P4 are all PMOS transistors and the MOS transistors Q_N1, Q_N2, Q_N3, and Q_N4 are all NMOS transistors. However, the invention is not limited thereto. For example, of the MOS transistors Q_P1, Q_N1, Q_P2, Q_N2, Q_P3, Q_N3, Q_P4, and Q_N4 may either be all PMOS transistors or NMOS transistors.

The full-bridge inverter FB_1 of the first DC-AC converting unit 252 is enabled by first and second P-type driving signal CONT_P1 and CONT_P2 and first and second N-type driving signal CONT_N1 and CONT_N2 to convert the second DC voltage DC2 into an AC voltage at a predetermined level. The transformer TF_1 of the first DC-AC converting unit 252 is supplied with the AC voltage at the predetermined level from the full-bridge inverter FB_1, increases the supplied AC voltage, and outputs the increased AC voltage as the power supply voltage Vac_1.

More specifically, when the first PMOS transistor Q_P1 and the second PMOS transistor Q_P2 are turned on, the first NMOS transistor Q_N1 and the second NMOS transistor Q_N2 are turned off, while when the first PMOS transistor Q_P1 and the second PMOS transistor Q_P2 are turned off, the first NMOS transistor Q_N1 and the second NMOS transistor Q_N2 are turned on.

The pair of first and second PMOS transistors Q_P1 and Q_P2 and the pair of first and second NMOS transistors Q_N1 and Q_N2 are alternately turned on/off, and thus the second DC voltage DC2 is applied to a primary coil CL1 of the transformer TF_1 while the polarity of the second DC voltage DC2 varies. For example, when the second DC voltage DC2 is 12 V, +12 V and −12 V are sequentially applied to the primary coil CL1 of the transformer TF_1.

The transformer TF_1 increases the AC voltage applied to the primary coil CL1 and outputs the increased AC voltage as the power supply voltage Vac_1. When the power supply voltage Vac_1 is supplied, the first lamp unit 300_1 emits light.

Depending on the value of the selection signal SEL, a switching unit 263 supplies the second P-type driving signal CONT_P2 to a gate G3 of a fourth PMOS transistor Q_P4 of the full-bridge inverter FB_2 or blocks the second P-type driving signal CONT_P2 and supplies the second N-type driving signal CONT_N2 to a gate G4 of a fourth NMOS transistor Q_N4 or blocks the second N-type driving signal CONT_N2. Accordingly, the second DC-AC converting unit 272 selectively does or does not supply the power supply voltage Vac_2 to the second lamp unit 300_2. In the embodiment illustrated, switching unit 263 includes an AND gate "AND", an OR gate "OR", and an inverter INV. The OR gate has the second P-type driving signal CONT_P2 and the selection signal SEL as inputs thereto, while the AND gate has the second N-type driving signal CONT_N2 and the inverted value of the selection signal SEL as inputs thereto. The output of the OR gate drives gate G3 of the fourth PMOS transistor Q_P4, while the output of the AND gate drives gate G4 of the fourth NMOS transistor Q_N4.

An example in which the second DC-AC converting unit 272 supplies the power supply voltage Vac_2 to the second lamp unit 300_2 will now be described in detail with reference to FIGS. 5A and 5C.

When the selection signal SEL is at the low level, the second P-type driving signal CONT_P2 is passed to the gate G3 of the fourth PMOS transistor Q_P4, and the second N-type driving signal CONT_N2 is passed to the gate G4 of the fourth NMOS transistor Q_N4. Therefore, in this case, since the second DC-AC converting unit 272 operates in the same manner as the above-mentioned first DC-AC converting unit 252, the AC voltage is applied to the primary coil CL2 of the transformer TF_2, and the transformer TF_2 increases the applied AC voltage and supplies the increased AC voltage to the second lamp unit 300_2 as the power supply voltage Vac_2. As a result, the second lamp unit 300_2 emits light.

An example in which the second DC-AC converting unit 272 does not supply the power supply voltage Vac_2 to the second lamp unit 300_2 will now be described in detail with reference to FIGS. 5B and 5C.

When the selection signal SEL is at the high level H, the high level voltage H is applied to the gate G3 of the fourth PMOS transistor Q_P4 and the low level L voltage is applied to the gate G4 of the fourth NMOS transistor Q_N4. Therefore, both the fourth PMOS transistor Q_P4 and the fourth NMOS transistor Q_N4 are turned off, and thus the second DC-AC converting unit 272 becomes a circuit as illustrated in FIG. 5B. In this case, even though the third PMOS transistor Q_P3 and the third NMOS transistor Q_N3 are turned on/off according to the second P-type driving signal CONT_P2 and the second N-type driving signal CONT_N2, the AC voltage is not applied to the primary coil CL2, such that the transformer TF_2 does not output the power supply voltage Vac_2. Accordingly, the second lamp unit 300_2 is in the OFF state.

Therefore, the DC-AC converting unit 243 selectively supplies the power supply voltage Vac_2 according to the value of the selection signal SEL such that both of the first and second lamp units 300_1 and 300_2 emit light or only the first lamp unit 300_1 emits light.

In this embodiment, the switching unit 263 controls both the fourth PMOS transistor Q_P4 and the fourth NMOS transistor Q_N4. However, the switching unit 263 may alternatively control either the fourth PMOS transistor Q_P4 or the fourth NMOS transistor Q_N4.

Figure 6A:
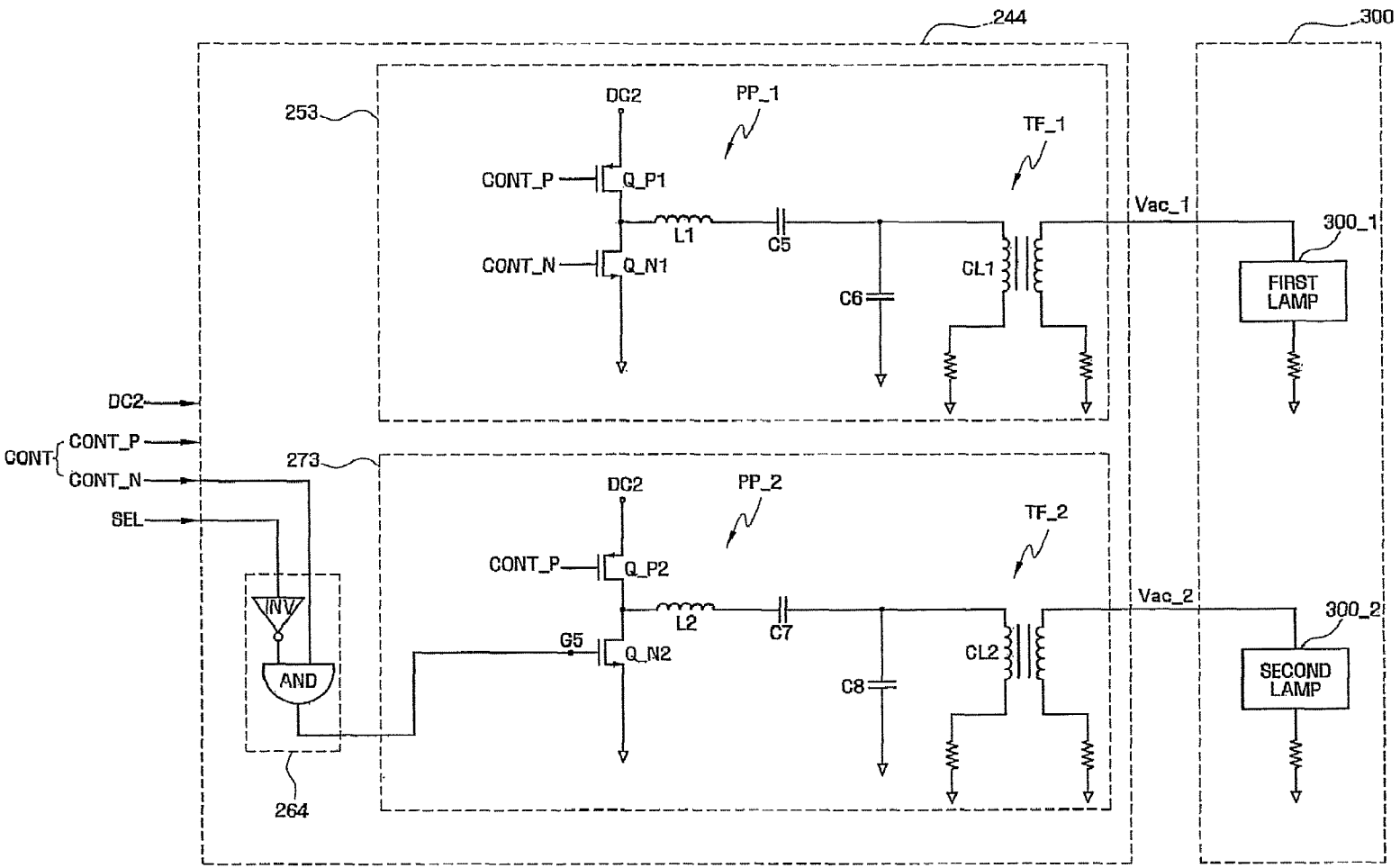
FIG. 6A is a circuit diagram illustrating another exemplary embodiment of the DC-AC converting unit of the power supply apparatus shown in FIGS. 1 and 2.
Figures 6B, 6C:
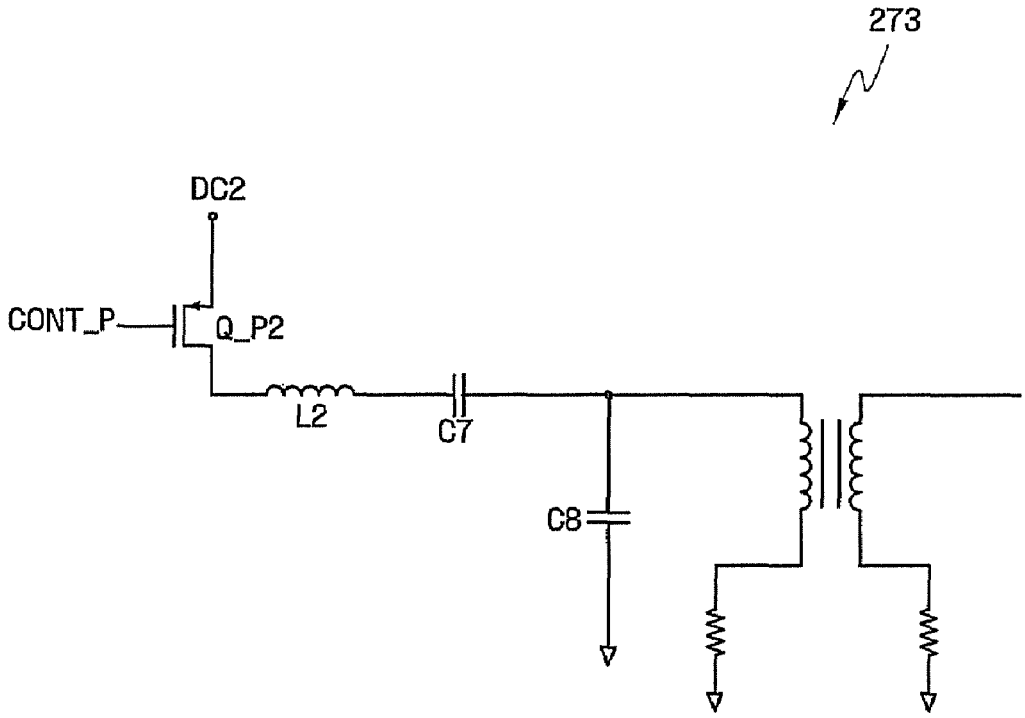
FIG. 6B is an equivalent circuit diagram of the second DC-AC converting unit included in the DC-AC converting unit of FIG. 6A when the selection signal is at the high level.
FIG. 6C is a table illustrating the operation of the second DC-AC converting unit of FIG. 6A.

A power supply apparatus according to another exemplary embodiment of the invention will now be described with reference to FIGS. 6A to 6C. FIG. 6A is a circuit diagram illustrating the DC-AC converting unit of the power supply apparatus according to another exemplary embodiment of the invention, FIG. 6B is an equivalent circuit diagram of a second DC-AC converting unit included in the DC-AC converting unit of FIG. 6A when the selection signal is at the high level, and FIG. 6C is a table illustrating the operation of the second DC-AC converting unit of FIG. 6A.

First, referring to FIG. 6A, a first push-pull inverter PP_1 includes MOS transistors Q_P1 and Q_N1, capacitors C5 and C6, and an inductor L1, while a second push-pull inverter PP_2 includes MOS transistors Q_P2 and Q_N2, capacitors C7 and C8, and an inductor L2. FIG. 6A illustrates an embodiment where the MOS transistors Q_P1 and Q_P2 are PMOS transistors and the MOS transistors Q_N1 and Q_N2 are NMOS transistors. However, the invention is not limited thereto. For example, MOS transistors Q_P1, Q_N1, Q_P2, and Q_N2 may all be either PMOS transistors or NMOS transistors.

The push-pull inverter PP_1 of a first DC-AC converting unit 253 is enabled by a driving signal CONT including a P-type driving signal CONT_P and an N-type driving signal CONT_N to convert the second DC voltage DC2 into an AC voltage at a predetermined level. A transformer TF_1 of the first DC-AC converting unit 253 is supplied with the AC voltage at the predetermined level from the push-pull inverter PP_1, increases the supplied AC voltage, and outputs the increased AC voltage as the power supply voltage Vac_1.

More specifically, a first PMOS transistor Q_P1 and a first NMOS transistor Q_N1 are alternately turned on/off. That is, when the first PMOS transistor Q_P1 is turned on, the first NMOS transistor Q_N1 is turned off, while when the first PMOS transistor Q_P1 is turned off, the first NMOS transistor Q_N1 is turned on.

While the first PMOS transistor Q_P1 and the first NMOS transistor Q_N1 are alternately turned on/off, an AC voltage is applied to a primary coil CL1 of the transformer TF_1 by the inductor L1 and the capacitors C5 and C6. The transformer TF_1 increases the AC voltage applied to the primary coil CL1 and outputs the increased AC voltage as the power supply voltage Vac_1. The first lamp unit 300_1 is supplied with the power supply voltage Vac_1 so as to emit light.

A switching unit 264 selectively supplies or does not supply the N-type driving signal CONT_N to a gate G5 of a second NMOS transistor Q_N2 and thus the second DC-AC converting unit 270 selectively does or does not supply the power supply voltage Vac_2 to the second lamp unit 300_2. In the embodiment illustrated, the switching unit 264 includes an AND gate "AND" and an inverter INV, having the selection signal SEL and the N-type driving signal CONT_N as respective inputs thereto. The inverted value of SEL and the N-type driving signal CONT_N are inputs to the AND gate, and the output of the AND gate is coupled to the gate G5 of NMOS transistor Q_N2.

An example in which a second DC-AC converting unit 273 supplies the power supply voltage Vac_2 to the second lamp unit 300_2 will now be described in detail with reference to FIGS. 6A and 6C.

When the selection signal SEL is at the low level L, the N-type driving signal CONT_N is passed through to the gate of the second NMOS transistor Q_N2. Therefore, in this case, since the second DC-AC converting unit 273 operates in the same manner as the above-mentioned first DC-AC converting unit 253, an AC voltage is applied to a primary coil CL2 of a transformer TF_2, and the transformer TF_2 increases the applied AC voltage and supplies the increased AC voltage to the second lamp unit 300_2, then the second lamp unit 300_2 emits light.

An example in which the second DC-AC converting unit 272 does not supply the power supply voltage Vac_2 to the second lamp unit 300_2 will now be described in detail with reference to FIGS. 6B and 6C.

When the selection signal SEL is at the high level H, a low level L voltage is applied to the gate G5 of the second NMOS transistor Q_N2, and thus the second NMOS transistor Q_N2 is turned off, such that the second DC-AC converting unit 273 becomes a circuit as illustrated in FIG. 6C. In this case, even though the second PMOS transistor Q_P2 is turned on/off according to the P-type driving signal CONT_P, capacitors C7 and C8 are charged to a second DC voltage and thus the AC voltage is not applied to the primary coil CL2. As a result, the transformer TF_2 does not output the power supply voltage Vac_2. Therefore, the second lamp unit 300_2 is in the OFF state.

In other words, the DC-AC converting unit 244 selectively supplies the power supply voltage Vac_2 according to the value of the selection signal SEL such that both of the first and second lamp units 300_1 and 300_2 emit light or only the first lamp unit 300_1 emits light.

The power supply apparatuses according to some of the above-mentioned exemplary embodiments can selectively supply the power supply voltages to the lamps by transmitting the driving signal to the second DC-AC converting unit or blocking the driving signal in response to the selection signal. Therefore, it is possible to reduce the power consumption of the lamps.

Figure 7:
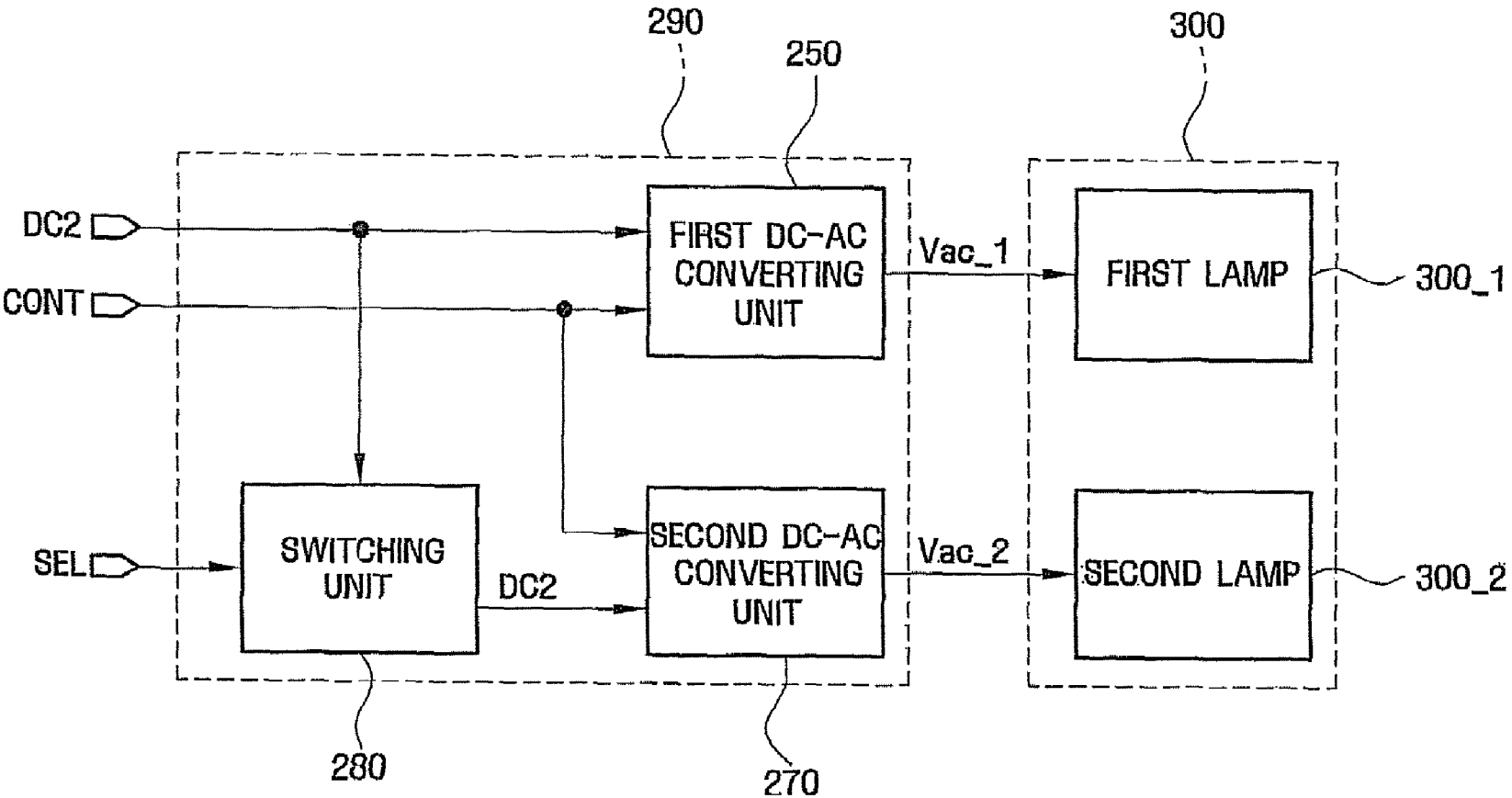
FIG. 7 is a block diagram illustrating a power supply apparatus according to another exemplary embodiment of the present invention.

A power supply apparatus according to certain exemplary embodiments of the invention will be described with reference to FIG. 7. FIG. 7 is a block diagram illustrating a power supply apparatus according to some exemplary embodiments of the invention.

Referring to FIG. 7, a DC-AC converting unit 290 includes a first DC-AC converting unit 250, a second DC-AC converting unit 270, and a switching unit 280. In contrast to the above-mentioned exemplary embodiments, the switching unit 280 either transmits the second DC voltage DC2 to the second DC-AC converting unit 270 or blocks transmission of the second DC voltage DC2 in response to the selection signal SEL. Therefore, the power supply apparatus 200 (FIG. 1) selectively supplies the power supply voltages Vac_1 and Vac_2 to the lamps 300_1 and 300_2 according to value of the selection signal SEL.

Exemplary embodiments will now be described with reference to FIGS. 8 to 10.

Figure 8:
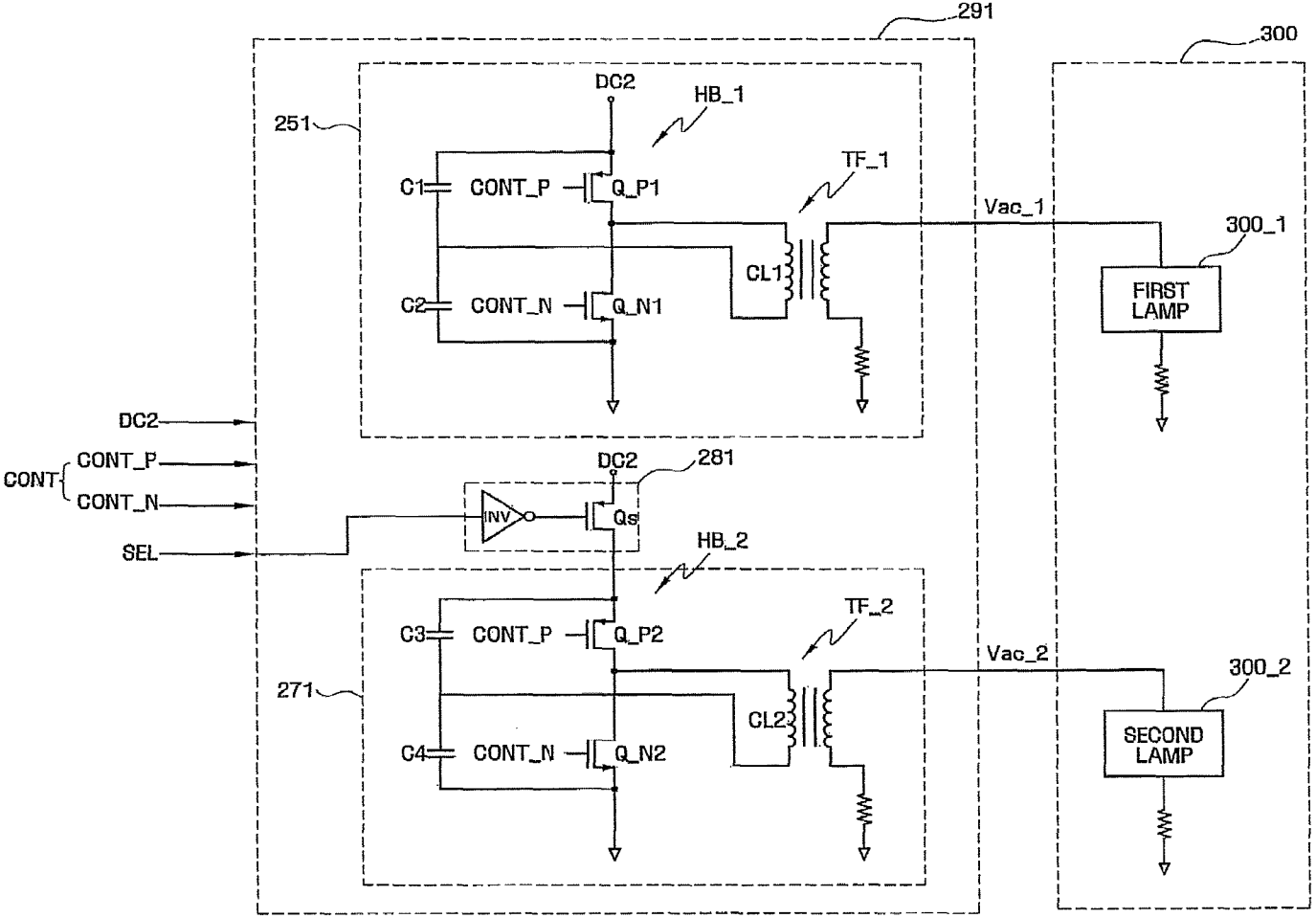
FIG. 8 is a circuit diagram illustrating a power supply apparatus according to another exemplary embodiment of the present invention.

FIG. 8 is a circuit diagram illustrating a power supply apparatus according to another exemplary embodiment of the invention. In FIG. 8, components having the same or similar functions as the components illustrated in FIG. 3A are designated by the same reference numerals, and thus a description thereof will be omitted.

Referring to FIG. 8, a first DC-AC converting unit 251 includes a half-bridge inverter HB_1 and a transformer TF_1, and a second DC-AC converting unit 271 includes a half-bridge inverter HB_2 and a transformer TF_2. A switching unit 281 includes an inverter INV and a MOS transistor Qs. In response to the selection signal SEL, the switching unit 281 either transmits the second DC voltage DC2 to the half-bridge inverter HB_2 of the second DC-AC converting unit 271 or blocks the transmission of the second DC voltage DC2 thereto.

For example, where the MOS transistor Qs is an NMOS transistor, when the selection signal SEL is at the high level, a low level voltage is applied to a gate of the NMOS transistor Qs and thus the NMOS transistor Qs is turned off. Therefore, since the second DC voltage DC2 is not applied to the half-bridge inverter HB_2, the second DC-AC converting unit 271 does not supply the power supply voltage Vac_2 to the second lamp unit 300_2.

That is, the DC-AC converting unit 291 selectively supplies the power supply voltage Vac_2 according to the value of the selection signal SEL such that both of the first and second lamp units 300_1 and 300_2 emit light or only the first lamp unit 300_1 emits light. Alternatively, the MOS transistor Qs may be a PMOS transistor and the inverter INV may be omitted.

Figure 9:
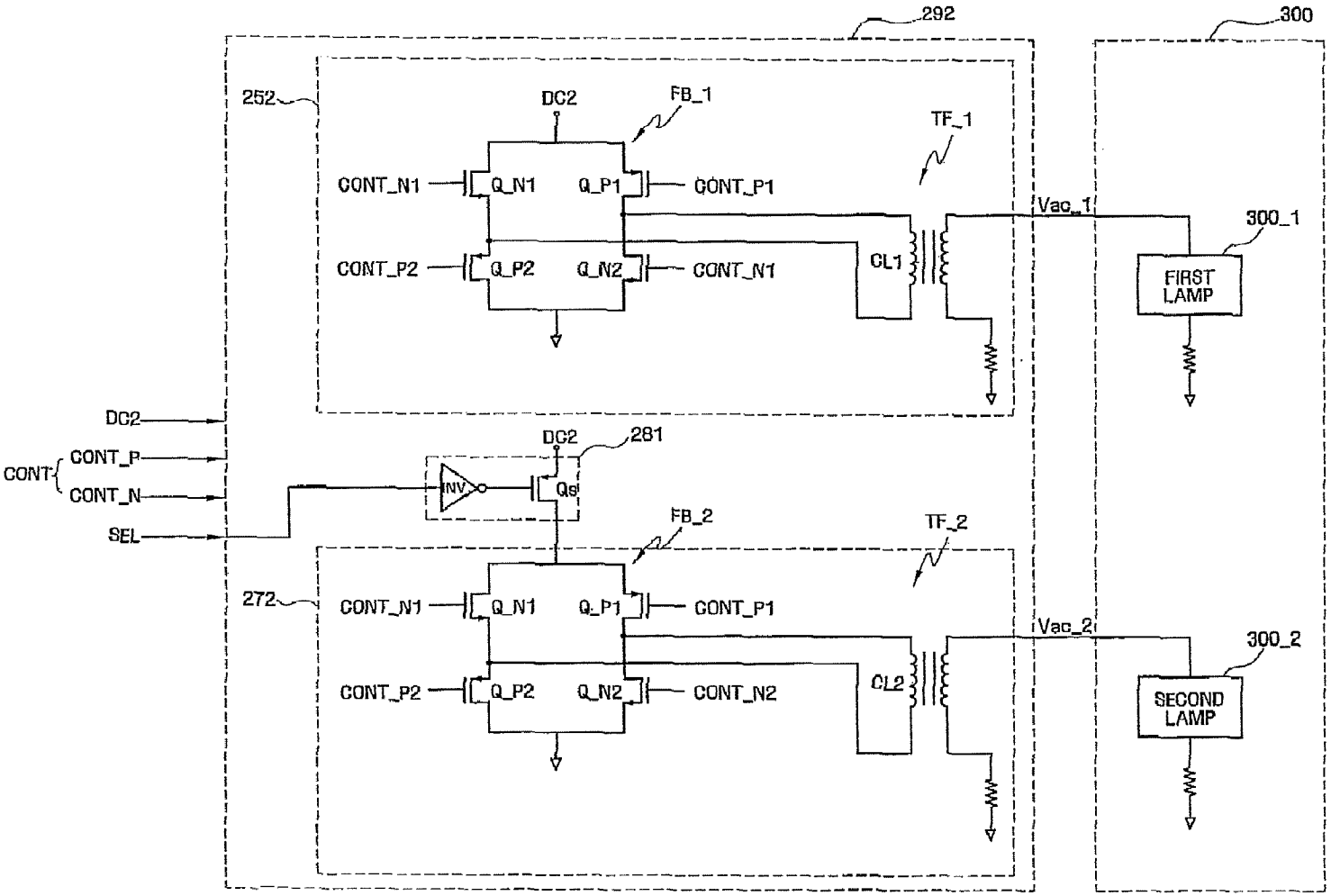
FIG. 9 is a circuit diagram illustrating a power supply apparatus according to another exemplary embodiment of the present invention.

FIG. 9 is a circuit diagram illustrating a power supply apparatus according to another exemplary embodiment of the invention. In FIG. 9, components having the same functions as the components illustrated in FIGS. 5A and 8 are designated by the same reference numerals and a detailed description thereof will be omitted for purposes of simplicity.

Referring to FIG. 9, a first DC-AC converting unit 252 includes a full-bridge inverter FB_1 and a transformer TF_1, and a second DC-AC converting unit includes a full-bridge inverter FB_2 and a transformer TF_2. A switching unit 281 includes an inverter INV and a MOS transistor Qs. In response to the selection signal SEL, the switching unit 281 either transmits the second DC voltage DC2 to the half-bridge inverter HB_2 of the second DC-AC converting unit 272 or blocks the transmission of second DC voltage DC2 thereto. Therefore, it is possible to selectively drive the second lamp unit 300_2 according to the value of the selection signal SEL.

That is, a DC-AC converting unit 292 selectively supplies the power supply voltage Vac_2 according to the value of the selection signal SEL such that both of the first and second lamp units 300_1 and 300_2 emit light or only the first lamp unit 300_1 emits light. Alternatively, the MOS transistor Qs may be a PMOS transistor and the inverter 1V may be omitted.

Figure 10:
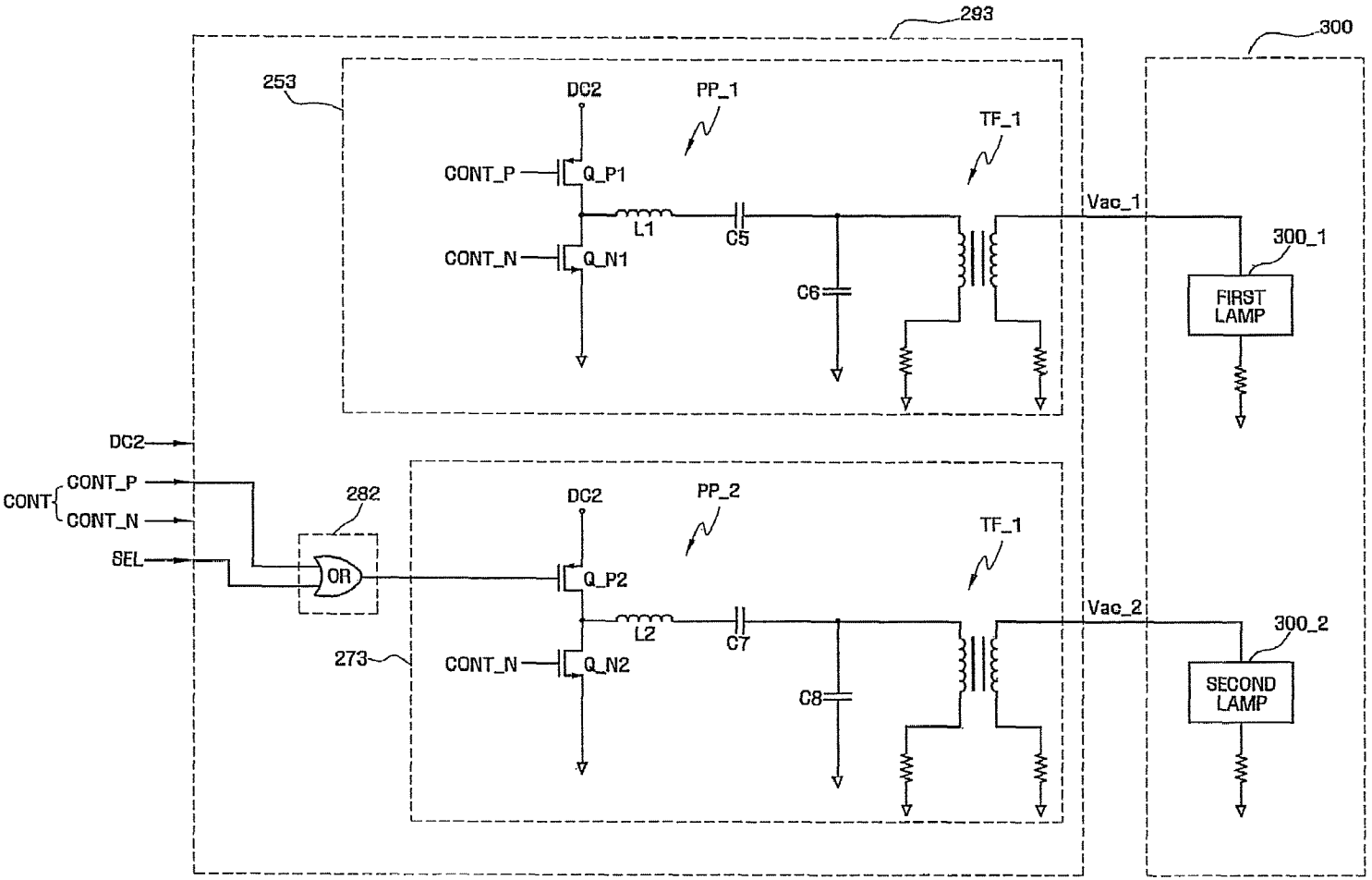
FIG. 10 is a circuit diagram illustrating a power supply apparatus according to another exemplary embodiment of the present invention.

FIG. 10 is a circuit diagram illustrating a power supply apparatus according to another exemplary embodiment of the invention. In FIG. 10, components having the same functions as the components illustrated in FIG. 6A are designated by the same reference numerals and a detailed description thereof will be omitted for purposes of simplicity.

Referring to FIG. 10, a first DC-AC converting unit 253 includes a push-pull inverter PP_1 and a transformer TF_1, and a second DC-AC converting unit 273 includes a push-pull inverter PP_2 and a transformer TF_2. A switching unit 282 includes an OR gate "OR". In response to the selection signal SEL, the switching unit 282 either transmits or blocks transmission of the second DC voltage DC2. In this embodiment, the switching unit 282 operates in the same or similar manner as the switching unit 260 illustrated in FIG. 3A and thus a detailed description thereof will be omitted.

Therefore, a DC-AC converting unit 293 selectively supplies the power supply voltage Vac_2 according to the value of the selection signal SEL such that both of the first and second lamp units 300_1 and 300_2 emit light or only the first lamp unit 300_1 emits light.

The power supply apparatuses according to the above-mentioned exemplary embodiments can selectively supply the power supply voltages to the lamps by transforming the second DC voltage to the second DC-AC converting unit or disrupting the second DC voltage. Therefore, it is possible to reduce the power consumption of the lamps.

Although the present invention has been described in connection with the exemplary embodiments of the present invention, it will be apparent to those skilled in the art that various modifications and changes may be made thereto without departing from the scope and spirit of the invention. Therefore, it should be understood that the above exemplary embodiments are not limitative, but illustrative in all aspects.

As described above, according to the power supply apparatus and a liquid crystal display including the power supply apparatus according to the invention, it is possible to selectively drive a plurality of lamps and thus to reduce the power consumption.

What is claimed is:

1. A power supply apparatus, comprising:

a first DC-AC converting unit enabled by a driving signal to convert a DC voltage into a first AC voltage, increase the first AC voltage, and supply the increased first AC voltage as a first power supply voltage;

a switching unit which selectively transmits the driving signal in response to a selection signal; and a second DC-AC converting unit enabled by the driving signal selectively transmitted by the switching unit to convert the DC voltage into a second AC voltage, increase the second AC voltage, and supply the increased second AC voltage as a second power supply voltage.

2. The power supply apparatus of claim 1, wherein the first and second DC-AC converting units comprise one or more of: half-bridge inverters, full-bridge inverters, and push-pull inverters.

3. The power supply apparatus of claim 2, wherein:

the first and second DC-AC converting units comprise a MOS transistor, and the switching unit is connected to a gate of a MOS transistor of the second DC-AC converting unit, wherein the switching unit transmits the driving signal to the gate when the selection signal is at a first logic level, and blocks the driving signal when the selection signal is at a second logic level.

4. The power supply apparatus of claim 3, wherein:

the MOS transistor is an NMOS transistor; and the switching unit performs a logic operation on the selection signal and the driving signal, so as to block the driving signal to the gate of the NMOS transistor when the selection signal is at the second logic level, and supply a voltage at a logic low level to deactivate the NMOS transistor.

5. The power supply apparatus of claim 4, wherein the switching unit comprises an AND gate.

6. The power supply apparatus of claim 3, wherein:

the MOS transistor is a PMOS transistor, and the switching unit performs a logic operation on the selection signal and the driving signal, so as to the driving signal to be supplied to a gate of the PMOS transistor when the selection signal is at the second logic level, and supply a voltage at a logic high level to deactivate the NMOS transistor.

7. The power supply apparatus of claim 6, wherein the switching unit comprises an OR gate.

8. The power supply apparatus of claim 1, wherein, whenever the switching unit does not transmit the driving signal, the second DC-AC converting unit does not supply the power supply voltage.

9. A power supply apparatus, comprising:

a first DC-AC converting unit enabled by a driving signal to convert a DC voltage into a first AC voltage, increase the first AC voltage, and supply the increased first AC voltage as a first power supply voltage;

a switching unit which selectively transmits the DC voltage in response to a selection signal; and a second DC-AC converting unit enabled by the driving signal to convert the DC voltage selectively transmitted by the switching unit into a second AC voltage, increase the second AC voltage, and supply the increased second AC voltage as a second power supply voltage.

10. The power supply apparatus of claim 9, wherein the switching unit comprises a MOS transistor.

11. The power supply apparatus of claim 9, wherein the first and second DC-AC converting units comprise one or more of: half-bridge inverters, full-bridge inverters, and push-pull inverters.

12. A liquid crystal display, comprising:

a backlight assembly which emits light and comprising a plurality of lamps arranged into a first lamp unit and a second lamp unit, and a power supply apparatus which supplies a power supply voltage to the first lamp unit and selectively supplies the power supply voltage to the second lamp unit in response to a selection signal; and a liquid crystal panel assembly which receives the light emitted from the backlight assembly and implements an image display wherein the power supply apparatus comprise a first DC-AC converting unit enabled by a driving signal to convert a DC voltage into a first AC voltage, increase the first AC voltage, and supply the increased first AC voltage as the power supply voltage to the first lamp unit; a switching unit which selectively transmits the driving signal in response to the selection signal; and a second DC-AC converting unit enabled by the driving signal selectively transmitted by the switching unit to convert the DC voltage into a second AC voltage, increase the second AC voltage, and supply the increased second AC voltage as the power supply voltage to the second lamp unit.

13. The liquid crystal display of claim 12, wherein the first and second DC-AC converting units comprise one of: half-bridge inverters, full-bridge inverters, and push-pull inverters.

14. The liquid crystal display of claim 13, wherein:

the first and second DC-AC converting units comprise a MOS transistor; and the switching unit is connected to a gate of a MOS transistor of the second DC-AC converting unit, wherein the switching unit transmits the driving signal to the gate when the selection signal is at a first logic level, and blocks the driving signal when the selection signal is at a second logic level.

15. The liquid crystal display of claim 14, wherein:

the MOS transistor is an NMOS transistor; and the switching unit performs a logic operation on the selection signal and the driving signal, so as to block the driving signal to the gate of the NMOS transistor when the selection signal is at the second logic level, and supply a voltage at a logic low level to deactivate the NMOS transistor.

16. The liquid crystal display of claim 15, wherein the switching unit comprises an AND gate.

17. The liquid crystal display of claim 14, wherein:

the MOS transistor is a PMOS transistor; and the switching unit performs a logic operation on the selection signal and the driving signal, so as to block the driving signal to the gate of the PMOS transistor when the selection signal is at the second logic level, and supply a voltage at a logic high level to deactivate the PMOS transistor.

18. The liquid crystal display of claim 17, wherein the switching unit comprises an OR gate.

* * * * *